US009243205B2

(12) United States Patent
Kaneko

(10) Patent No.: US 9,243,205 B2
(45) Date of Patent: Jan. 26, 2016

(54) REFRIGERATOR OIL COMPOSITION FOR CARBON DIOXIDE COOLANT

(75) Inventor: Masato Kaneko, Chiba (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 837 days.

(21) Appl. No.: 13/166,941

(22) Filed: Jun. 23, 2011

(65) Prior Publication Data

US 2011/0248206 A1 Oct. 13, 2011

Related U.S. Application Data

(63) Continuation of application No. 11/574,062, filed as application No. PCT/JP2004/012443 on Aug. 24, 2004, now abandoned.

(51) Int. Cl.
*C09K 5/00* (2006.01)
*C10M 171/00* (2006.01)

(52) U.S. Cl.
CPC ... *C10M 171/008* (2013.01); *C10M 2203/1006* (2013.01); *C10M 2203/1045* (2013.01); *C10M 2205/0206* (2013.01); *C10M 2207/2835* (2013.01); *C10M 2209/043* (2013.01); *C10M 2209/1033* (2013.01); *C10N 2220/02* (2013.01); *C10N 2220/021* (2013.01); *C10N 2220/022* (2013.01); *C10N 2220/306* (2013.01); *C10N 2230/00* (2013.01); *C10N 2230/06* (2013.01); *C10N 2230/10* (2013.01); *C10N 2240/30* (2013.01); *F25B 2309/061* (2013.01); *F25B 2500/16* (2013.01)

(58) Field of Classification Search
USPC ..... 508/539, 579, 422, 433, 462, 465, 485, 508/487, 496; 252/68
See application file for complete search history.

(56) References Cited

U.S. PATENT DOCUMENTS

| | | | | |
|---|---|---|---|---|
| 4,983,313 | A * | 1/1991 | Kaneko et al. | 252/68 |
| 6,306,803 | B1 * | 10/2001 | Tazaki | 508/539 |
| 6,815,402 | B2 * | 11/2004 | Tazaki et al. | 508/422 |

FOREIGN PATENT DOCUMENTS

| | | |
|---|---|---|
| JP | 10-046168 | 2/1998 |
| JP | 10-046169 | 2/1998 |
| JP | 11-236584 | 8/1999 |
| JP | 2000-104084 | 4/2000 |
| JP | 2000-169869 | 6/2000 |
| JP | 2001-3072 | 1/2001 |
| JP | 2001-19989 | 1/2001 |
| JP | 2001-049282 | 2/2001 |
| JP | 01-048127 | 7/2001 |
| JP | 2001-294886 | 10/2001 |
| JP | 2002-155290 | 5/2002 |
| JP | 2002-180074 | 6/2002 |
| JP | 2002-180075 | 6/2002 |
| JP | 2002-193882 | 7/2002 |
| JP | 2002-194368 | 7/2002 |

OTHER PUBLICATIONS

Japan Office Action issued Jan. 4, 2011, in Patent Application No. 2006-531186.

Supplementary Partial European Search Report in corresponding European Application No. 04772399 dated Dec. 3, 2012.

A. Hauk, et al., "Thermodynamic and Fluid-Dynamic Properties of Carbon Dioxide with Different Lubricants in Cooling Circuits for Automobile Application", Ind. Eng. Chem., Res., 2000, vol. 39, pp. 4546-651. XP-002687433.

* cited by examiner

*Primary Examiner* — Monique Peets
(74) *Attorney, Agent, or Firm* — Oblon, McClelland, Maier & Neustadt, L.L.P.

(57) ABSTRACT

Disclosed is a refrigerator oil composition for use with carbon dioxide refrigerant, characterized in that the composition dissolves in an amount of at least 0.1% by mass in a supercritical carbon dioxide at a temperature of 100° C. under a pressure of 15 Mpa.

The invention provides a refrigerator oil composition for carbon dioxide refrigerant which composition is employed in a refrigerating system operated in a supercritical state of carbon dioxide refrigerant and, particularly, such a composition which can enhance heat-exchange efficiency during passage of supercritical carbon dioxide through a heat exchanger as well as which has excellent durability and lubrication performance.

24 Claims, 5 Drawing Sheets

The amount of refrigerator oil dissolved in $CO_2$ (% by mass)

REFRIGERATOR OIL COMPOSITION FOR CARBON DIOXIDE COOLANT

REFERENCE TO PRIOR APPLICATIONS

This application is a Continuation of U.S. application Ser. No. 11/574,062, filed Feb. 22, 2007; which is a 371 of PCT/JP04/12443, filed Aug. 24, 2004.

TECHNICAL FIELD

The present invention relates to a refrigerator oil composition for use with carbon dioxide refrigerant. More particularly, the invention relates to a refrigerator oil composition for carbon dioxide refrigerant, which composition is employed in a refrigerating system operated in a supercritical state of carbon dioxide refrigerant. In particular, the composition can enhance heat-exchange efficiency during passage of supercritical carbon dioxide through a heat exchanger and exhibit excellent durability and lubrication performance.

BACKGROUND ART

In general, in a compression refrigeration cycle for refrigerators; e.g., a compression refrigerator having a compressor, a condenser, an expansion valve, and an evaporator, a fluid mixture of a refrigerant and a lubricating oil is circulated in a closed system. Hitherto, in such a compression refrigerator, chlorofluorocarbon such as dichlorodifluoromethane (R-12) or chlorodifluoromethane (R-22) is employed as a refrigerant, and a variety of lubricating oils have been produced and employed in combination with such a refrigerant. Thus, when the aforementioned chlorofluoro compounds that have heretofore been employed as refrigerant are released in air, the ozonosphere in the stratosphere may be depleted, resulting in environmental pollution. Therefore, recently, use of the Flon compound is more and more rigorously controlled throughout the world. Under such circumstances, hydrofluorocarbons and fluorocarbons such as 1,1,1,2-tetrafluoroethane (R-134a) have become of interest as new refrigerants. Although these hydrofluorocarbons and similar compounds are less destructive to the ozonosphere, they have a long life in the atmosphere, possibly resulting in global warming. Therefore, in recent years, there has been investigated use of naturally occurring refrigerant that does not raise the aforementioned problems.

Carbon dioxide is an excellent candidate, since it is harmless to the environment and is safe to human beings. In addition, carbon dioxide has advantages such as easy availability at any place and considerably low cost without necessity for recovery. By virtue of being harmless to the global environment, being free of flammability, and having low toxicity, naturally occurring carbon dioxide coolant has attracted attention in recent years. Possible applications of carbon dioxide refrigerants include electric air conditioners for automobile use, heating apparatuses for use in cold areas, and hot-water supplying systems.

Among these applications, hot-water supplying apparatus will be further described in terms of further enhancement of energy conservation and efficiency, which is demanded in relation to global environmental issues. One advantage of carbon dioxide is that, when carbon dioxide is employed in a heat-pump hot-water supplier, running cost of the supplier is reduced to about ⅕ and coefficient of performance (COP) is enhanced to 3.0 or higher, as compared with gas-system hot-water suppliers generally employed as domestic hot-water suppliers. In contrast, when the aforementioned HFC coolant is employed in heat-pump hot-water suppliers, the maximum temperature of water supplied by the suppliers is limited to about 60° C., because of thermal properties of the coolant. In this case, a compressor of considerably higher output must be further employed. However, when carbon dioxide is employed as a coolant, hot water at about 90° C. can be supplied by virtue of the thermal properties of carbon dioxide. Thus, employment of carbon dioxide is advantageous.

Meanwhile, refrigerator oil is used in a closed-type electric compressor and plays roles including lubrication, sealing, cooling, etc. of sliding parts. However, use of carbon dioxide as a refrigerant often raises the problem that a system employing carbon dioxide therein requires higher discharge pressure and has a higher temperature, as compared with the case where R-134a or the like is employed. As a result, the refrigerator oil in the system is exposed to carbon dioxide under supercritical conditions. Therefore, if a conventionally used lubricating oil is employed for lubrication, unexpected problems arise. For example, the lubricating oil becomes less stable, failing to ensure long-term stable use, and lubrication performance such as wear resistance becomes poor.

Conventionally, synthetic oils having miscibility with refrigerant (e.g., polyalkylene glycol and polyol ester) are generally employed refrigerator oils for use in a refrigeration cycle employing carbon dioxide or a compressor.

Specifically, Japanese Patent Application Laid-Open (kokai) Nos. 10-46169 and 2001-153476 disclose a lubricating oil composition for refrigerators, which composition comprises at least one species selected from polyalkylene glycol and polyvinyl ether and which composition has a kinematic viscosity of at least 5 $mm^2/s$ at 100° C., a refrigerating cycle employing the oil composition, and a compressor employing the oil composition. Japanese Patent Application Laid-Open (kokai) Nos. 2000-273477 and 2001-19987 disclose a refrigerator oil composition employing polyester-polyol.

However, some polyalkylene glycols have poor insulating performance attributed to the molecular structure thereof. Since refrigerating oils employed in a closed-type electric compressor are required to serve as electrically insulating oil, when such a polyalkylene glycol species is employed, a short circuit may occur between hermetic terminals provided so as to supply external electric power to a motor of the compressor. Furthermore, high dielectric constant and dielectric tangent result in large leakage current, which may cause accidents by an electric shock.

Polyester-polyol, having excessively high miscibility with carbon dioxide refrigerant, considerably lowers viscosity when it is in a compressor and forms a solution with carbon dioxide, impairing sealing performance on the high-pressure side. In this case, compressing efficiency lowers, and flow of the refrigerating oil into the refrigeration cycle increases, possibly causing a drop in heat exchanging efficiency.

Under such circumstances, an object of the present invention is to provide a refrigerator oil composition for carbon dioxide refrigerant, of which composition is employed in a refrigerating system operated in a supercritical state of carbon dioxide refrigerant and, particularly, to provide such a composition which can enhance heat-exchange efficiency during passage of supercritical carbon dioxide through a heat exchanger as well as which has excellent durability and lubrication performance.

DISCLOSURE OF THE INVENTION

The present inventors have carried out extensive studies in order to attain the aforementioned objects, and have found that the objects can be attained by a refrigerator oil composition dissolves in an amount of a specific value or more in a supercritical carbon dioxide under specific pressure and temperature conditions, and particularly by a refrigerator oil composition wherein, when the composition is dissolved to saturation in a supercritical carbon dioxide under the above conditions, the resultant mixture exhibits a viscosity, a dielectric constant, a density, and a thermal conductivity each falling within a predetermined range. The present invention has been accomplished on the basis of this findings.

Accordingly, the present invention provides the following:

(1) A refrigerator oil composition for use with carbon dioxide refrigerant, characterized in that the composition dissolves in an amount of at least 0.1% by mass in a supercritical carbon dioxide at a temperature of 100° C. under a pressure of 15 Mpa.

(2) A refrigerator oil composition for use with carbon dioxide refrigerant as claimed in (1) above, wherein, a mixture of the supercritical carbon dioxide at a temperature of 100° C. under a pressure of 15 Mpa and the refrigerator oil composition dissolved in the supercritical carbon dioxide to saturation has a viscosity of at most 1 mPa·s.

(3) A refrigerator oil composition for use with carbon dioxide refrigerant as claimed in (1) above, wherein, a mixture of the supercritical carbon dioxide at a temperature of 100° C. under a pressure of 15 Mpa and the refrigerator oil composition has a dielectric constant of 1 to 5.

(4) A refrigerator oil composition for use with carbon dioxide refrigerant as claimed in (1) above, wherein, a mixture of the supercritical carbon dioxide at a temperature of 100° C. under a pressure of 15 Mpa and the refrigerator oil composition has a density of 0.1 to 0.9 g/cm$^3$.

(5) A refrigerator oil composition for use with carbon dioxide refrigerant as claimed in (1) above, wherein, a mixture of the supercritical carbon dioxide at a temperature of 100° C. under a pressure of 15 Mpa and the refrigerator oil composition has a thermal conductivity of 0.0001 to 0.01 W/m·K.

(6) A refrigerator oil composition for use with carbon dioxide refrigerant as claimed in (1) above, which comprises at least one base oil selected from the groups consist of polyoxyalkylene glycol and a derivative thereof, polyvinyl ether, polyol ester, poly(α-olefin), alkylbenzene, and mineral oil, and has a kinematic viscosity of 3 to 1,000 mm$^2$/s at 40° C. and a hue (ASTM) at most 1.

(7) A refrigerator oil composition for use with carbon dioxide refrigerant as claimed in (1) above, which comprises at least one member selected from the groups consist of an extreme pressure agent, an antioxidant, an acidscavenger, and a defoaming agent.

(8) A refrigerator oil composition for use with carbon dioxide refrigerant as claimed in (1) above, which is for use in a hot-water supplying machine, an automobile air-conditioner, an air-conditioner, a refrigerator, a heat pump, a hot-water supplying system employed in an automatic vending machine or a showcase, or a refrigeration-heating system.

BRIEF DESCRIPTION OF THE DRAWINGS

Each of FIGS. 1 to 4 is a flow chart showing an exemplary compression refrigeration cycle to which the refrigerator oil composition of the present invention can be applied.

BEST MODES FOR CARRYING OUT THE INVENTION

Figure 1:
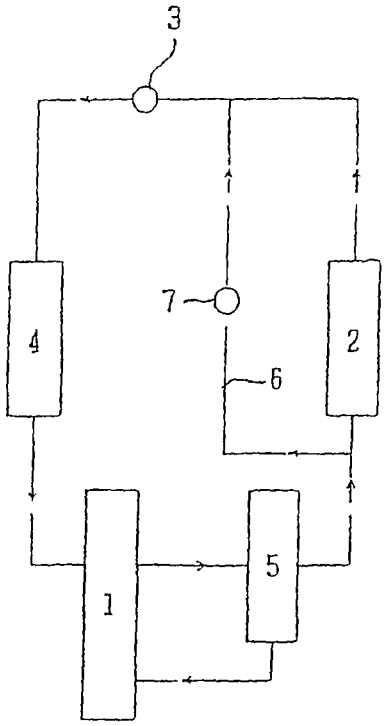
Figure 2:
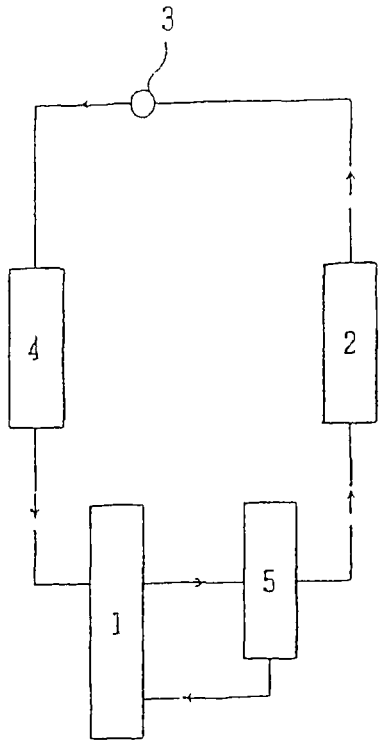
Figure 3:
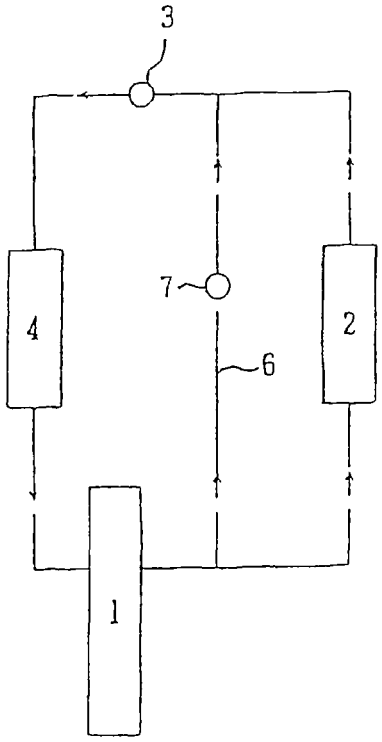
Figure 4:
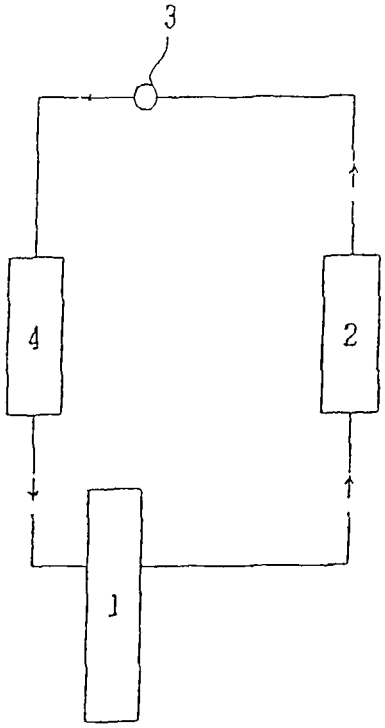

Characteristics of the refrigerator oil composition of the present invention for use with carbon dioxide refrigerant will now be described.

The refrigerator oil composition essentially dissolves in an amount of at least 0.1% by mass in a supercritical carbon dioxide at a temperature of 100° C. under a pressure of 15 Mpa. When the refrigerator oil composition dissolves in an amount of less than 0.1% by mass, a refrigerator fluid composition containing supercritical carbon dioxide and the refrigerator oil composition exhibits poor heat exchange efficiency during passage of the fluid composition through a heat exchanger. The amount is preferably at least 0.3%, more preferably at least 0.5% by mass. No particular limitation is imposed on the upper limit of the amount, and the amount is generally about 10% by mass.

In order for the refrigerator oil composition containing supercritical carbon dioxide and the refrigerator oil composition to attain desired heat exchange efficiency, durability, and lubrication performance during passage of the fluid composition through a heat exchanger, the mixture of a 100° C.-15 MPa supercritical carbon dioxide and the refrigerator oil composition dissolved to saturation therein preferably exhibits (1) a viscosity of at most 1 mPa·s; (2) a dielectric constant of 1 to 5; (3) a density of 0.1 to 0.9 g/cm$^3$; and (4) a thermal conductivity of 0.0001 to 0.01 W/m·K.

The viscosity is more preferably at most 0.5 mPa·s. No particular limitation is imposed on the lower limit thereof, and the lower limit is generally about 0.02 mPa·s. The dielectric constant is more preferably 1 to 2, and the density is more preferably 0.2 to 0.7 g/cm$^3$. The thermal conductivity is more preferably 0.001 to 0.01 W/m·K. Methods for determining these properties will be described hereinbelow.

Next, the base oil of the refrigerator oil composition will be described.

No particular limitation is imposed on the base oil employed in the refrigerator oil composition of the present invention, so long as the base oil provides a refrigerator oil composition which exhibits the aforementioned physical properties. For example, at least one species selected from among polyoxyalkylene glycol and a derivative thereof, polyvinyl ether, polyol ester, poly(α-olefin), alkylbenzene, and mineral oil is employed.

The polyoxyalkylene glycol or a derivative thereof which may be employed in the invention is, for example, a compound represented by the formula (I):

$$R^1—[(OR^2)_m—OR^3]_n \quad (I)$$

(wherein $R^1$ represents a hydrogen atom, an alkyl group having from 1 to 10 carbon atoms, an acyl group having from 2 to 10 carbon atoms, or an aliphatic hydrocarbon group having from 1 to 10 carbon atoms and having from 2 to 6 bonding sites; $R^2$ represents an alkylene group having from 2 to 4 carbon atoms; $R^3$ represents a hydrogen atom, an alkyl group having from 1 to 10 carbon atoms, or an acyl group having from 2 to 10 carbon atoms; n is an integer of 1 to 6; m is a number which gives an average value of m×n of 6 to 80), or a polyoxyalkylene glycol derivative having at least one structural unit represented by the formula (II):

(II)

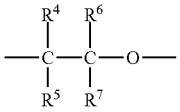

[wherein each of $R^4$ to $R^7$ represents a hydrogen atom, a monovalent hydrocarbon group having from 1 to 10 carbon atoms, or a group represented by the formula (III):

(III)

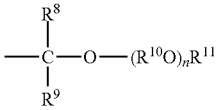

(wherein each of $R^8$ and $R^9$ represents a hydrogen atom, a monovalent hydrocarbon group having from 1 to 10 carbon atoms, or an alkoxyalkyl group having from 2 to 20 carbon atoms; $R^{10}$ represents an alkylene group having from 2 to 5 carbon atoms, an alkyl-group-substituted alkylene group having 2 to 5 carbon atoms in total, or an alkoxyalkyl-group-substituted alkylene group having from 4 to 10 carbon atoms in total; n is an integer of 0 to 20; and $R^{11}$ represents a monovalent hydrocarbon group having from 1 to 10 carbon atoms); and at least one of $R^4$ to $R^7$ is represented by the formula (III)].

Details of these polyoxyalkylene glycols are disclosed in sections [0012] to [0026] of Japanese Patent Application Laid-Open (kokai) 2001-49282.

Examples of preferred polyoxyalkylene glycols represented by the aforementioned formula (I) include polypropylene glycol dimethyl ether, polyethylene-polypropylene glycol copolymer dimethyl ether, polypropylene glycol monobutyl ether, and polypropylene glycol diacetate.

Examples of the polyvinyl ether include a polyvinyl ether compound having a structural unit represented by, for example, the formula (IV):

(IV)

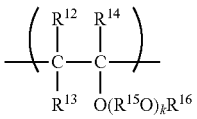

(wherein $R^{12}$, $R^{13}$, and $R^{14}$, which may be identical to or different from one another, each represent a hydrogen atom, a hydrocarbon group having from 1 to 8 carbon atoms; $R^{15}$ represents a divalent hydrocarbon group having from 1 to 10 carbon atoms; $R^{15}$ represents a hydrocarbon group having from 1 to 20 carbon atoms; k is an average number of 0 to 10; each of $R^{12}$ to $R^{16}$ in one structural unit and its counterpart in another structural unit may be identical to or different from each other; and when a plurality of $R^{15}$Os are present, the $R^{15}$Os may be identical to or different from one another).

Alternatively, there may also be employed a polyvinyl ether compound formed of a block or random copolymer having a structural unit represented by the aforementioned (IV) and a structural unit represented by the formula (V):

(V)

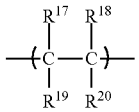

(wherein $R^{17}$ to $R^{20}$, which may be identical to or different from one another, each represent a hydrogen atom or a hydrocarbon group having from 1 to 20 carbon atoms; and each of $R^{17}$ to $R^{20}$ in one structural unit and its counterpart in another structural unit may be identical to or different from each other).

Details of these polyvinyl ethers are disclosed in sections [0027] to [0045] of Japanese Patent Application Laid-Open (kokai) 2001-49282.

Examples of preferred polyvinyl ethers include polyethyl vinyl ether and polyethyl vinyl ether-polyisobutyl vinyl ether copolymer.

Examples of the polyol ester include esterification products between a polyhydric alcohol and a saturated or unsaturated fatty acid having from 5 to 20 carbon atoms. Examples of the polyhydric alcohol include hexamethylene glycol, neopentyl glycol, decamethylene glycol, pentaerythritol, dipentaerythritol, trimethylolethane, and trimethylolpropane. Examples of the saturated or unsaturated fatty acid having from 5 to 20 carbon atoms include pentanoic acid, caproic acid, caprylic acid, capric acid, 2-ethylhexanoic acid, 3,5,5-trimethylhexanoic acid, lauric acid, myristic acid, palmitic acid, stearic acid, eicosanoic acid, and oleic acid.

Specific examples of the polyol esters include hexamethylene glycol caprylic acid ester, hexamethylene glycol nonanoic acid ester, decamethylene glycol caprylic acid ester, trimethylolpropane caproic acid ester, trimethylolpropane capric acid ester, pentaerythritol 2-ethylhexanoic acid ester, and pentaerythritol 3,5,5-trimethylhexanoic acid ester.

Examples of preferred poly(α-olefin) include α-olefin oligomers, ethylene-α-olefin copolymers, and hydrogenated products thereof. Among them, α-olefin oligomers having from 6 to 14 carbon atoms are particularly preferred poly(α-olefins), with 1-decene oligomer being particularly preferred. Among ethylene-α-olefin copolymers, ethylene-propylene copolymer is preferably employed.

Examples of the alkylbenzenes include propylbenzene and butylbenzene. Examples of the mineral oil include paraffinic mineral oil, naphthenic mineral oil, and intermediate mineral oil. Specific examples include solvent-refined or hydrogenated light neutral oil, medium neutral oil, heavy neutral oil, and bright stock.

In the present invention, preferably, one or more base oils to be employed are appropriately selected from the aforementioned base oils so that the refrigerator oil composition having the aforementioned properties can be produced. The base oil preferably has a kinematic viscosity of 3 to 1,000 $mm^2/s$ at 40° C. and a hue (ASTM) of at most 1. When the kinematic viscosity falls within the above range, excellent lubrication performance can be attained. More preferably, the kinematic viscosity is 5 to 500 $mm^2/s$ at 40° C., with 5 to 200 $mm^2/s$ at 40° C. being particularly preferred. A base oil having a hue (ASTM) of at most 1 exhibits excellent durability.

The refrigerator oil composition may further contain at least one species selected from among an extreme pressure agent, an antioxidant, an acidscavenger, and a defoaming agent.

Examples of the extreme pressure agent include a carboxylic acid metal salt. In the present invention, the carboxylic acid metal salt is preferably a carboxylic acid metal salt having from 3 to 60 carbon atoms, more preferably a carboxylic acid metal salt having from 3 to 30 carbon atoms, particularly preferably a carboxylic acid metal salt having from 12 to 30 carbon atoms. The extreme pressure agent may be a dimer acid or trimer acid of the fatty acid(s) or a dicarboxylic acid metal salt having from 3 to 30 carbon atoms. Of these, a fatty acid metal salt having from 12 to 30 carbon atoms and a dicarboxylic acid metal salt having from 3 to 30 carbon atoms are particularly preferred.

The metal element forming the metal salts is preferably an alkali metal or an alkaline earth meta, with an alkali metal being particularly preferred.

Examples of the carboxylic acid forming the metal salts include variety of carboxylic acid such as an aliphatic saturated monocarboxylic acid, an aliphatic unsaturated carboxylic acid, an aliphatic dicarboxylic acid, and an aromatic carboxylic acid. Specific examples of the aliphatic unsaturated carboxylic acid include linear saturated acids such as caproic acid, caprylic acid, capric acid, lauric acid, myristic acid, palmitic acid, stearic acid, arachic acid, cerotic acid, and lacceric acid; and branched fatty acids such as isopentanoic acid, 2-methylpentanoic acid, 2-methylbutanoic acid, 2,2-dimethylbutanoic acid, 2-methylhexanoic acid, 5-methylhexanoic acid, 2,2-dimethylheptanoic acid, 2-ethyl-2-methylbutanoic acid, 2-ethylhexanoic acid, dimethylhexanoic acid, 2-n-propyl-pentanoic acid, 3,5,5-trimethylhexanoic acid, dimethyloctanoic acid, isotridecanoic acid, isomyristic acid, isostearic acid, isoarachic acid, and isohexanoic acid. Specific examples of the unsaturated carboxylic acid include palmitoleic acid, oleic acid, elaidic acid, linoleic acid, linolenic acid; and unsaturated hydroxy acids such as ricinoleic acid. Specific examples of the aliphatic dicarboxylic acid include adipic acid, azelaic acid, and sebacic acid. Specific examples of the aromatic carboxylic acid include benzoic acid, phthalic acid, trimellitic acid, and pyromellitic acid. Alicyclic fatty acids such as naphthenic acid may be employed. These carboxylic acids may be used singly or in combination of two or more species.

No particular limitation is imposed on the metal species forming the carboxylic acid metal salts. Examples include alkali metals such as lithium, potassium, and sodium; alkaline earth metals such as magnesium, calcium, and strontium; and other metals such as zinc, nickel, and aluminum. Among them, alkali metals and alkaline earth metals are preferred, with alkali metals being particularly preferred. only one metal species or two or more metal species may be introduced to one carboxylic acid species.

The refrigerator oil composition of the present invention preferably has a carboxylic acid metal salt content of 0.001 to 5% by mass, particularly preferably 0.005 to 3% by mass. When the salt content is less than 0.001% by mass, wear resistance is insufficient, whereas when the salt content exceeds 5% by mass, stability may decrease. Needless to say, both cases are not preferred.

Examples of the extreme pressure agent employed in the present invention include a phosphate ester, an acid phosphate ester, a phosphite ester, an acid phosphite ester, and a phosphorous compound such as an amine salt thereof. Examples of the phosphate ester include triaryl phosphates, trialkyl phosphates, trialkylaryl phosphates, triarylalkyl phosphates, and trialkenyl phosphates. Specific examples include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate.

Examples of the acid phosphate ester include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

Examples of the phosphite ester include triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenyl isodecyl phosphite, tristearyl phosphite, trioleyl phosphite, and 2-ethylhexyl diphenyl phosphite.

Examples of the acid phosphite ester include dibutyl hydrogen phosphite, dilauryl hydrogen phosphite, dioleyl hydrogen phosphite, distearyl hydrogen phosphite, and diphenyl hydrogen phosphite.

Examples of the amines which formamine salts with the phosphate esters include monosubstituted amines, disubstituted amines, and trisubstituted amines, which are represented by the formula (VI):

$$R_sNH_{3-s} \quad \text{(VI)}$$

(wherein R represents an alkyl group or alkenyl group having from 3 to 30 carbon atoms, an aryl group or aralkyl group having from 6 to 30 carbon atoms, or a hydroxyalkyl group having from 2 to 30 carbon atoms; s is 1, 2, or 3; when a plurality of Rs are present, these Rs may be identical to or different from one another). The alkyl or alkenyl group having from 3 to 30 carbon atoms represented by R in formula (VI) may be linear, branched, or cyclic.

Examples of the monosubstituted amines include butylamine, pentylamine, hexylamine, cyclohexylamine, octylamine, laurylamine, stearylamine, oleylamine, and benzylamine. Examples of the disubstituted amines include dibutylamine, dipentylamine, dihexylamine, dicyclohexylamine, dioctylamine, dilaurylamine, distearylamine, dioleylamine, dibenzylamine, stearylmonoethanolamine, decylmonoethanolamine, hexylmonopropanolamine, benzylmonoethanolamine, phenylmonoethanolamine, and tolylmonopropanol. Examples of the trisubstituted amines include tributylamine, tripentylamine, trihexylamine, tricyclohexylamine, trioctylamine, trilaurylamine, tristearylamine, trioleylamine, tribenzylamine, dioleylmonoethanolamine, dilaurylmonopropanolamine, dioctylmonoethanolamine, dihexylmonopropanolamine, dibutylmonopropaolamine, oleyldiethanolamine, stearyldipropanolamine, lauryldiethanolamine, octyldipropanolamine, butyldiethanolamine, benzyldiethanolamine, phenyldiethanolamine, tolyldipronanolamine, xylyldiethanolamine, triethanolamine, and tripropanolamine.

Among these phosphorus compound extreme pressure agents, tricresyl phosphate, tri(nonylphenyl) phosphite, dioleyl hydrogen phosphite, and 2-ethylhexyl diphenyl phosphite are particularly preferred from the viewpoint of properties such as extreme pressure performance and tribological characteristics.

Other than the aforementioned extreme pressure agents, there may be employed sulfur compound extreme pressure agents such as sulfidized fats and oils, sulfurized fatty acid, sulfurized esters, sulfurized olefins, dihydrocarbyl polysulfides, thiocarbamate compounds, thioterpene compounds, and dialkyl thiodipropionate compounds. The sulfurized fats and oils are produced through reaction of a fat or an oil (e.g., lard, whale oil, vegetable oil, or fish oil) with sulfur or a sulfur-containing compound. Although no particular limitation is imposed on the sulfur content, the content is preferably 5 to 30% by mass. Specific examples include sulfurized lard, sulfurized rape seed oil, sulfurized castor oil, sulfurized soy bean oil, and sulfurized rice bran oil. Examples of the sulfurized fatty acids include sulfurized oleic acid. Examples of the sulfurized esters include sulfurized methyl oleate and sulfurized octyl ester of rice bran fatty acid.

Examples of the sulfurized olefins include compounds represented by the following formula (VII):

$$R^{21}—S_t—R^{22} \quad \text{(VII)}$$

(wherein $R^{21}$ represents an alkenyl group having from 2 to 15 carbon atoms, $R^{22}$ represents an alkyl group or alkenyl group having from 2 to 15 carbon atoms; and t is an integer of 1 to 8). These compounds are produced through reaction between an olefin having from 2 to 15 carbon atoms or a dimer to tetramer thereof and a sulfidizing agent such as sulfur or sulfur chloride. Preferred olefins are propylene, isobutene, and diisobutene.

Examples of the dihydrocarbyl polysulfides include compounds represented by the following formula (VIII):

$$R^{23}—S_u—R^{24} \quad \text{(VIII)}$$

(wherein $R^{23}$ and $R^{24}$, which may be identical to or different from each other, each represent an alkyl group or cyclic alkyl group having from 1 to 20 carbon atoms, an aryl group having from 6 to 20 carbon atoms, an alkyl aryl group having from 7 to 20 carbon atoms, or an arylalkyl group having from 7 to 20 carbon atoms; and u is an integer of 2 to 8). When each of $R^{23}$ and $R^{24}$ is an alkyl group, the compound is called alkyl sulfide.

Examples of the group represented by $R^{23}$ or $R^{24}$ in the formula (VIII) include methyl, ethyl, n-propyl, isopropyl, n-butyl, isobutyl, sec-butyl, tert-butyl, pentyl groups, hexyl groups, heptyl groups, octyl groups, nonyl groups, decyl groups, dodecyl groups, cyclohexyl, cyclooctyl, phenyl, naphthyl, tolyl, xylyl, benzyl, and phenetyl.

Examples of preferred dihydrocarbyl polysulfides include dibenzyl polysulfides, di-tert-nonyl polysulfides, didodecyl polysulfides, di-tert-butyl polysulfides, dioctyl polysulfides, diphenyl polysulfides, and dicyclohexyl polysulfides.

Examples of the thiocarbamate compounds include zinc dithiocarbamate. Examples of the thioterpene compounds include a reaction product of phosphorus pentasulfide and pinene. Examples of the dialkyl thiodipropionate compounds include dilauryl thiodipropionate and distearyl thiodipropionate.

In the present invention, the aforementioned extreme pressure agents may be used singly or in combination of two or more species. In a preferred embodiment, one or more species selected from among carboxylic acid metal salts and phosphorus compound extreme pressure agents are used in combination. Particularly preferably, a combination of a carboxylic acid metal salt and a phosphorus compound extreme pressure agent is preferred. In this case, one or more carboxylic acid metal salts and one or more phosphorus compound extreme pressure agents are used in combination.

Generally, the amount of extreme pressure agent(s) other than the aforementioned phosphorus compound extreme pressure agent incorporated into the composition is preferably 0.001 to 5% by mass, particularly preferably 0.01 to 3% by mass. When the amount is less than 0.001% by mass, lubricity may be poor, whereas when the amount exceeds 5% by mass, sludge formation may be promoted.

Examples of preferably incorporated antioxidants include phenol-based compounds such as 2,6-di-tert-butyl-4-methylphenol, 2,6-di-tert-butyl-4-ethylphenol, and 2,2'-methylenebis(4-methyl-6-tert-butylphenol), and amine-based compounds such as phenyl-α-naphthylamine and N,N'-diphenyl-p-phenylenediamine. The antioxidant is generally incorporated into the composition in an amount of 0.01 to 5% by mass, preferably 0.05 to 3% by mass. When the amount is less than 0.01% by mass, the anti-oxidation effect may be poor, whereas when the amount exceeds 5% by mass, the effect commensurate with the addition is no longer attained.

Examples of the acidscavenger include phenyl glycidyl ether, alkyl glycidyl ether, alkylene glycol glycidyl ether, cyclohexene oxide, α-olefin oxide, and epoxy compounds such as epoxidized soy bean oil. Among them, phenyl glycidyl ether, alkyl glycidyl ether, alkylene glycol glycidyl ether, cyclohexene oxide, and α-olefin oxide are preferred.

The alkyl group of the alkyl glycidyl ether and the alkylene group of the alkylene glycol glycidyl ether may be branched and, generally, each have 3 to 30 carbon atoms, preferably 4 to 24 carbon atoms, particularly preferably 6 to 16 carbon atoms. The α-olefin oxide generally has 4 to 30 carbon atoms in total, preferably 4 to 24 carbon atoms, particularly preferably 6 to 16 carbon atoms. In the present invention, the aforementioned acid-scavengers may be used singly or in combination of two or more species. Generally, the acid-scavenger is preferably incorporated into the composition in an amount of 0.005 to 5% by mass, particularly preferably 0.05 to 3% by mass. When the amount is less than 0.005% by mass, the effect commensurate with the addition may fail to be attained, whereas when the amount exceeds 5% by mass, sludge may be formed. Needless to say, both cases are not preferred.

According to the present invention, the acidscavenger incorporated into the composition enhances stability of the composition under exposure to supercritical carbon dioxide. In the case where the aforementioned extreme pressure agent and antioxidant are used in combination, stability of the composition can be further enhanced.

Examples of the defoaming agent include silicone oil and fluorosilicone oil.

Without impairing the object of the present invention, into the refrigerator oil composition of the present invention, other known additives such as a copper-inactivating agent such as N—[N,N'-dialkyl(alkyl having from 3 to 12 carbon atoms) aminomethyl]triazole may appropriately be incorporated.

In the present invention, the carbon dioxide refrigerant contains carbon dioxide serving as a predominant component and may further contain a hydrocarbon refrigerant such as propane or isobutane; an ammonia-based refrigerant; or a chlorofluoro compound refrigerant (typically 1,1,1,2-tetrafluoroethane (R-134a)) such as hydrofluorocarbon or fluorocarbon. In the case of the above refrigerant mixtures, the effect of the present invention can be attained, so long as each refrigerant contains carbon dioxide as a predominant component (particularly preferably at least 90% by mass).

In a method for lubrication of a refrigerator employing the refrigerator oil composition of the present invention, the aforementioned carbon dioxide refrigerant and the refrigerator oil composition are preferably employed at a ratio (refrigerant/refrigerator oil composition) by mass of 99/1 to 10/90, more preferably 95/5 to 30/70. When the amount of refrigerant is smaller than the above range, freezing performance is impaired, whereas when the amount exceeds the above range, lubrication performance is poor. The refrigerator oil composition of the present invention can be employed in a variety of refrigerators and is particularly suitably employed in a compression refrigeration cycle of a compression refrigerator. For example, the refrigerator oil composition of the present invention is most effectively employed in compression refrigeration cycles having an oil separator and/or a hot gas line, which are shown in attached FIGS. 1 to 4. In general, a compression refrigeration cycle includes a compressor, a condenser, an expansion valve, and an evaporator.

In FIGS. 1 to 4, numeral 1 denotes a compressor, 2 denotes a condenser, 3 denotes an expansion valve, 4 denotes an evaporator, 5 denotes an oil separator, 6 denotes a hot gas line, and 7 denotes a hot gas line valve.

When the refrigerator oil composition of the present invention is employed for lubrication in a refrigerator based on a refrigeration cycle employing the aforementioned carbon-dioxide-based refrigerant, excellent heat exchange efficiency can be attained, and the composition exhibits excellent stability and lubricity, ensuring long-term stable use thereof.

The refrigerator oil composition of the present invention may be used in, for example, a hot-water supplying machine, an automobile air-conditioner, an air-conditioner, a refrigerator, a heat pump, a hot-water supplying system employed in an automatic vending machine or a showcase, or a refrigeration-heating system.

Next, the hot-water supplying system will be described.

Figure 5:
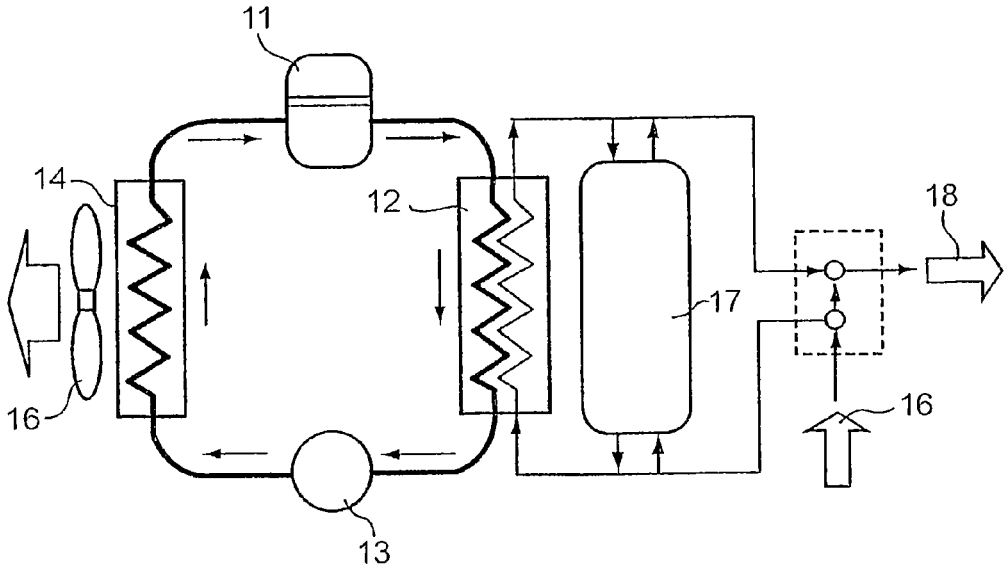
FIG. 5 shows an essential configuration of a heat-pump hot-water supplying machine.

FIG. 5 shows an essential configuration of a heat-pump hot-water supplying machine. As shown in FIG. 5, the hot-water supplying system includes a refrigeration cycle in which carbon dioxide refrigerant is circulated, and a heating cycle for heating supplied water.

The refrigeration cycle will be described. A closed-type electric compressor 11, which is placed in a sealable container or a similar container, compresses refrigerant gas (carbon dioxide refrigerant) at low temperature and pressure, and in turn discharges high-temperature, high-pressure refrigerant gas to a water-coolant heat exchanger 12 (heat exchanger for heat radiation). The refrigerant gas fed to the water-coolant heat exchanger 12 gives the heat to low-temperature water through sensible heat exchange. Subsequently, the refrigerant passes through a pressure-reducer 13, to thereby form low-temperature, low-pressure refrigerant, which is transferred to a heat exchanger 14 (heat exchanger for heat absorption). The refrigerant fed to the heat exchanger 14 absorbs heat to evaporate, and cold air is radiated by means of a blowing fan 15.

The low-temperature, low-pressure refrigerant gas is transferred again, from the heat exchanger 14, to the compressor 11 through suction. The above cycle is repeated. Since carbon dioxide refrigerant can realize a supercritical cycle, supercritical conditions are ensured at high pressure. Thus, a desired high pressure can be attained, and water of about 100° C. can be readily provided.

The water-heating cycle will next be described. First, low-temperature water fed through a water intake hole 16 is transferred to the water-coolant heat exchanger 12, where water absorbs heat to provide hot water. The hot water is transferred to a hot water reservoir tank 17, and supplied through a water outlet hole 18. In order to control water temperature, the supplied water may be mixed with hot water fed directly through the water-coolant heat exchanger 12.

The present invention will next be described in more detail by way of examples, which should not be construed as limiting the invention thereto.

The following is the refrigerator oils employed in the Examples.

A1: Polypropylene glycol dimethyl ether, kinematic viscosity (at 40° C.): 42 $mm^2/s$, and hue (ASTM): <0.5

A2: Polypropylene-polyethylene glycol copolymer dimethyl ether, (PO/PE=8/2 (mass)), kinematic viscosity (at 40° C.): 100 $mm^2/s$, and hue (ASTM): <0.5

A3: Polyethyl vinyl ether-polyisobutyl vinyl ether copolymer, (EV/BV=1/9 (mass)), viscosity (at 40° C.): 68 $mm^2/s$, and hue (ASTM): <0.5

A4: Polyethyl vinyl ether, viscosity (at 40° C.): 430 $mm^2/s$, and hue (ASTM): <0.5

A5: Pentaerythritol ester of 2-ethylhexanoic acid/3,5,5-trimethylhexanoic acid mixture (1/1 (mass)), kinematic viscosity (at 40° C.): 65 $mm^2/s$, and hue (ASTM): <0.5

A6: poly(α-olefin), kinematic viscosity (at 40° C.): 28 $mm^2/s$, and hue (ASTM): <0.5

A7: Paraffinic mineral oil, hydrogenated product, kinematic viscosity (at 40° C.): 32 $mm^2/s$, and hue (ASTM): <0.5

A8: Naphthenic mineral oil, kinematic viscosity (at 40° C.): 56 $mm^2/s$, S content: 0.03% by mass, and hue (ASTM): <0.5

A9: Polypropylene glycol dimethyl ether, kinematic viscosity (at 40° C.): 56 $mm^2/s$, and hue (ASTM): 1.5

A10: Polyethyl vinyl ether, kinematic viscosity (at 40° C.): 570 $mm^2/s$, and hue (ASTM): 1.5

A11: Pentaerythritol ester of 2-ethylhexanoic acid/3,5,5-trimethylhexanoic acid mixture (1/1 (mass)), kinematic viscosity (at 40° C.): 65 $mm^2/s$, and hue (ASTM): 2.0

A12: Paraffinic mineral oil, solvent purified, kinematic viscosity (at 40° C.): 450 $mm^2/s$, and hue (ASTM): 2.0

B1: Polybutene, kinematic viscosity (at 40° C.): 1,500 $mm^2/s$, and hue (ASTM): <0.5

B2: $CO_2$ (single component)

Refrigerator oil samples A1 to A6 and B1 were produced under an atmosphere (nitrogen >99% by volume, oxygen <1% by volume) through respective methods, and refrigerator oil samples A9 to A11 were produced under an atmosphere (nitrogen 95% by volume, oxygen 5% by volume) through respective methods.

EXAMPLES 1 TO 8, COMPARATIVE EXAMPLE 1, AND REFERENTIAL EXAMPLE 1

Figure 6:
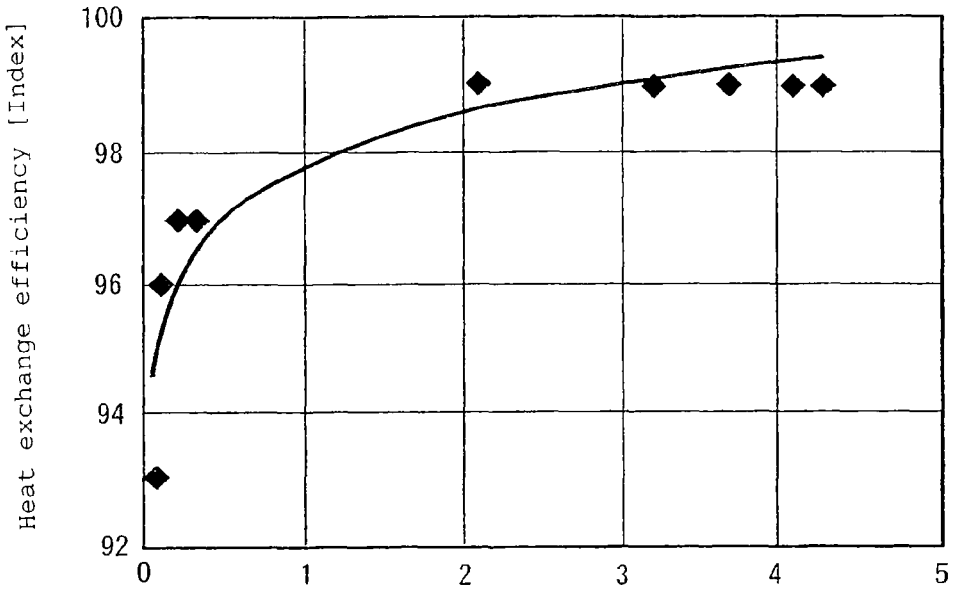
FIG. 6 is a graph showing the relationship between the amount of refrigerator oil dissolves in $CO_2$ and heat exchange efficiency.

Characteristic values of the refrigerator oil samples shown in Table 1 were determined through the method described below. Table 1 shows the results. FIG. 6 is a graph showing the relationship between the amount of refrigerator oil dissolves in $CO_2$ and heat exchange efficiency.

(1) The Amount of Refrigerator Oil Dissolves in 15 MPa-100° C. Supercritical $CO_2$ A mixture containing a refrigerator oil dissolved in 15 MPa-100° C. supercritical $CO_2$ was sampled and weighed. After removal of $CO_2$, the remaining refrigerator oil was weighed. From two mass values, the amount of refrigerator oil dissolves was calculated.

(2) Viscosity of Mixtures

Viscosity of a mixture containing a refrigerator oil dissolved to saturation in 15 MPa-100° C. supercritical $CO_2$ was determined by means of a viscometer set in a pressure container.

(3) Dielectric Constant of Mixtures

Dielectric constant of a mixture containing a refrigerator oil dissolved to saturation in 15 MPa-100° C. supercritical $CO_2$ was determined by means of a dielectric constant meter set in a pressure container.

(4) Density of Mixtures

Density of a mixture containing a refrigerator oil dissolved to saturation in 15 MPa-100° C. supercritical $CO_2$ was determined by means of a density measuring cell.

(5) Heat Exchange Efficiency

Heat exchange efficiency of a heat exchanger (condenser) during operation in a supercritical state employing a $CO_2$ refrigeration cycle was determined. The efficiency is represented by an index with respect to 100, which is a heat exchange efficiency obtained in the case where $CO_2$ was used as a single component.

TABLE 1

| | Refrigerator oil | The amount of refrigerator oil dissolved in supercritical $CO_2$ (mass %) | Viscosity of mixture (mPa · s) | Dielectric constant of mixture | Density of mixture (g/cm$^3$) | Heat exchange efficiency [index] |
|---|---|---|---|---|---|---|
| Ex. 1 | A1 | 3.2 | 0.07 | 1.9 | 0.49 | 99 |
| Ex. 2 | A2 | 2.1 | 0.06 | 1.8 | 0.48 | 99 |
| Ex. 3 | A3 | 3.7 | 0.07 | 1.9 | 0.50 | 99 |
| Ex. 4 | A4 | 4.1 | 0.12 | 2.2 | 0.50 | 99 |
| Ex. 5 | A5 | 4.3 | 0.08 | 2.1 | 0.51 | 99 |
| Ex. 6 | A6 | 0.2 | 0.02 | 1.5 | — | 96 |
| Ex. 7 | A7 | 0.2 | 0.03 | 1.5 | — | 97 |
| Ex. 8 | A8 | 0.3 | 0.04 | 1.5 | — | 97 |
| Comp. Ex. 1 | B1 | 0.05 | 0.01 | 1.4 | — | 93 |
| Ref. Ex. 1 | B2 | — | 0.01> | 1.3 | — | 100 |

EXAMPLES 9 TO 16

Each of the refrigerator oils shown in Table 2 (50 g), $CO_2$ (50 g), and catalytic amounts of Fe, Cu, and Al were placed in an autoclave. A durability test of the mixture was performed by maintaining the mixture at 250° C. for 10 days. Acid value of the oil was determined, and appearance of the oil and sludge formation were checked.

Heat exchange efficiency of a heat exchanger employing the oil after completion of the durability test was determined in the following manner.

Specifically, a $CO_2$ refrigeration cycle was operated in a supercritical state for 2,000 hours. Heat exchange efficiency of the heat exchanger (condenser) during this operation was determined, and the efficiency is represented by an index with respect to 100, which is a heat exchange efficiency obtained in the case where $CO_2$ was used as a single component.

The results are shown in Table 2.

TABLE 2

| | Refrigerator oil | The amount of refrigerator oil dissolved in supercritical $CO_2$ (mass %) | Refrigerator oil characteristics after autoclave test: Appearance | Acid value (mgKOH/g) | Sludge formation | Heat exchange efficiency after durability test [index] |
|---|---|---|---|---|---|---|
| Ex. 9 | A1 | 3.2 | Fair | 0.01 | No | 99 |
| Ex. 10 | A4 | 4.1 | Fair | 0.01 | No | 99 |
| Ex. 11 | A5 | 4.3 | Fair | 0.02 | No | 99 |
| Ex. 12 | A7 | 0.2 | Fair | 0.01 | No | 99 |
| Ex. 13 | A9 | 3.2 | Brown | 0.05 | Yes | 96 |
| Ex. 14 | A10 | 4.1 | Brown | 0.04 | Yes | 97 |
| Ex. 15 | A11 | 4.3 | Brown | 2.3 | Yes | 92 |
| Ex. 16 | A12 | 0.2 | Brown | 0.04 | Yes | 95 |

As is clear from Table 2, when a refrigerator oil exhibiting a hue (ASTM) greater than 1 was used, the refrigerator oil assumed brown and exhibited an increase in acid value, after the durability test. In addition, sludge was formed, resulting in decrease in heat exchange efficiency.

INDUSTRIAL APPLICABILITY

The refrigerator oil composition of the present invention for use with carbon dioxide refrigerant is employed in a refrigerating system operated in a supercritical state of carbon dioxide refrigerant. In particular, the composition can enhance heat-exchange efficiency during passage of supercritical carbon dioxide through a heat exchanger as well as has excellent durability and lubrication performance. The a refrigerator oil composition is employed in, for example, a hot-water supplying machine, an automobile air-conditioner, an air-conditioner, a refrigerator, a heat pump, a hot-water supplying system employed in an automatic vending machine or a showcase, or a refrigeration-heating system.

The invention claimed is:

1. A method for improving the heat exchange efficiency of a carbon dioxide refrigerant, comprising:

combining a refrigerant comprising carbon dioxide with a refrigerator oil composition, wherein the refrigerator oil composition comprises a base oil which has a hue (ASTM) of at most 1, and the refrigerator oil composition dissolves in an amount of at least 0.5% by mass in a supercritical carbon dioxide at a temperature of 100° C. under a pressure of 15 Mpa.

2. A method of improved heat exchange efficiency of a super critical carbon dioxide refrigerant, comprising:

(1) combining a refrigerant comprising carbon dioxide with a refrigerator oil composition, wherein (a) the refrigerator oil composition comprises a base oil which has a hue (ASTM) of at most 1, and (b) the refrigerator oil composition dissolves in an amount of at least 0.5% by mass in a supercritical carbon dioxide at a temperature of 100° C. under a pressure of 15 Mpa, followed by (2) passing the combined refrigerant and refrigerator oil composition through a heat exchanger, wherein the carbon dioxide is in a supercritical state.

3. The method of claim 1, wherein the combined refrigerant and refrigerator oil composition has a heat exchange efficiency of 99 or more represented by an index with respect to 100, which is the heat exchange efficiency of obtained using carbon dioxide as a single component.

4. The method of claim 2, wherein the combined refrigerant and refrigerator oil composition has a heat exchange efficiency of 99 or more represented by an index with respect to 100, which is the heat exchange efficiency of obtained using carbon dioxide as a single component.

5. The method of claim 1, wherein the base oil comprises a polyoxyalkylene glycol, a derivative of a polyoxyalkylene glycol, a polyvinyl ether, a polyol ester, or a mixture thereof, and wherein the base oil has a kinematic viscosity of 3 to 1,000 $mm^2/s$ at 40° C.

6. The method of claim 1, wherein the base oil is a poly(α-olefin), an alkylbenzene, or a mineral oil, and wherein the base oil has a kinematic viscosity of 3 to 1,000 $mm^2/s$ at 40° C.

7. The method of claim 5, wherein the derivative of a polyoxyalkylene glycol is present and comprises:

(I) a compound of formula (I):

$$R^1\text{-}[(OR^2)_m\text{—}OR^3]_n \quad \text{(I)},$$

wherein $R^1$ is a hydrogen atom, an alkyl group comprising from 1 to 10 carbon atoms, an acyl group comprising from 2 to 10 carbon atoms, or an aliphatic hydrocarbon group comprising from 1 to 10 carbon atoms and from 2 to 6 bonding sites, $R^2$ is an alkylene group comprising from 2 to 4 carbon atoms, $R^3$ is a hydrogen atom, an alkyl group comprising from 1 to 10 carbon atoms, or an acyl group comprising from 2 to 10 carbon atoms, n is an integer of 1 to 6, m is a number which gives an average value of a product, m×n, of 6 to 80;

(II) a polyoxyalkylene glycol derivative comprising at least one structural unit of formula (II):

(II)

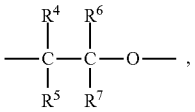

wherein $R^4$ to $R^7$ are independently a hydrogen atom, a monovalent hydrocarbon group comprising from 1 to 10 carbon atoms, or a group of formula (III), provided that at least one of $R^4$ to $R^7$ is of formula (III):

(III)

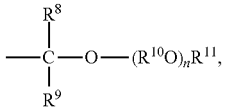

wherein $R^8$ and $R^9$ are independently a hydrogen atom, a monovalent hydrocarbon group comprising from 1 to 10 carbon atoms, or an alkoxyalkyl group comprising from 2 to 20 carbon atoms, $R^{10}$ is an alkylene group comprising from 2 to 5 carbon atoms, an alkyl-group-substituted alkylene group comprising 2 to 5 carbon atoms in total, or an alkoxyalkyl-group-substituted alkylene group comprising from 4 to 10 carbon atoms in total, n is an integer of 0 to 20, and $R^{11}$ is a monovalent hydrocarbon group comprising from 1 to 10 carbon atoms;

or a mixture of (I) and (II).

8. The method of claim 5, wherein the derivative of a polyoxyalkylene glycol is present and comprises polypropylene glycol dimethyl ether, polyethylene-polypropylene glycol copolymer dimethyl ether, polypropylene glycol monobutyl ether, polypropylene glycol diacetate, or a mixture thereof.

9. The method of claim 5, wherein the polyvinyl ether is present and comprises:

(IV) a polyvinyl ether compound comprising a structural unit of formula (IV):

(IV)

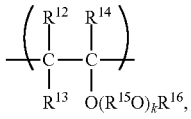

wherein $R^{12}$, $R^{13}$, and $R^{14}$ are independently a hydrogen atom, a hydrocarbon group comprising from 1 to 8 carbon atoms, $R^{15}$ is independently a divalent hydrocarbon group comprising from 1 to 10 carbon atoms, $R^{16}$ is a hydrocarbon group comprising from 1 to 20 carbon atoms, k is an average number of 0 to 10, wherein each of $R^{12}$ to $R^{16}$ in one structural unit and its counterpart in another structural unit are identical to or different from each other;

(V) a block or random copolymer comprising a structural unit of formula (IV) and a structural unit of formula (V):

(V)

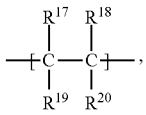

wherein $R^{17}$ to $R^{20}$ are independently a hydrogen atom or a hydrocarbon group comprising from 1 to 20 carbon atoms, and each of $R^{17}$ to $R^{20}$ in one structural unit and its counterpart in another structural unit are identical to or different from each other;

or a mixture thereof.

10. The method of claim 5, wherein the polyvinyl ether is present and comprises a polyethyl vinyl ether, a polyethyl vinyl ether-polyisobutyl vinyl ether copolymer, or a mixture thereof.

11. The method of claim 5, wherein the polyol ester is present and comprises:

an esterification product of a polyhydric alcohol and a saturated fatty acid comprising from 5 to 20 carbon atoms;

an esterification product of a polyhydric alcohol and an unsaturated fatty acid comprising from 5 to 20 carbon atoms;

or a mixture thereof.

12. The method of claim 5, wherein the polyol ester is present and comprises hexamethylene glycol caprylic acid ester, hexamethylene glycol nonanoic acid ester, decamethylene glycol caprylic acid ester, trimethylolpropane caproic acid ester, trimethylolpropane capric acid ester, pentaerythritol 2-ethylhexanoic acid ester, pentaerythritol 3,5,5-trimethylhexanoic acid ester, or a mixture thereof.

13. The method of claim 11, wherein the polyhydric alcohol comprises hexamethylene glycol, neopentyl glycol, decamethylene glycol, pentaerythritol, dipentaerythritol, trimethylolethane, trimethylolpropane, or a mixture thereof.

14. The method of claim 11, wherein the saturated or unsaturated fatty acid comprises pentanoic acid, caproic acid, caprylic acid, capric acid, 2-ethylhexanoic acid, 3,5,5-trimethylhexanoic acid, lauric acid, myristic acid, palmitic acid, stearic acid, eicosanoic acid, oleic acid, or a mixture thereof.

15. The method of claim 6, wherein the poly(α-olefin) is present and comprises an α-olefin oligomer, an ethylene-α-olefin copolymer, a hydrogenated product of an α-olefin oligomer, a hydrogenated product of an ethylene-α-olefin copolymer, or a mixture thereof.

16. The method of claim 6, wherein the alkylbenzene is present and comprises propylbenzene, butylbenzene, or a mixture thereof.

17. The method of claim 6, wherein the mineral oil is present and comprises a paraffinic mineral oil, a naphthenic mineral oil, an intermediate mineral oil, or a mixture thereof.

18. The method of claim 2, wherein, for a mixture of the supercritical carbon dioxide and the refrigerator oil composition dissolved to saturation at 100° C. under a pressure of 15 MPa, a viscosity is at most 1 mPa·s.

19. The method of claim 2, wherein, for a mixture of the supercritical carbon dioxide and the refrigerator oil composition dissolved to saturation at 100° C. under a pressure of 15 MPa, a dielectric constant is in a range of 1 to 5.

20. The method of claim 2, wherein, for a mixture of the supercritical carbon dioxide and the refrigerator oil composition dissolved to saturation at 100° C. under a pressure of 15 MPa, a density is in a range of 0.1 to 0.9 g/cm$^3$.

21. The method of claim 2, wherein, for a mixture of the supercritical carbon dioxide and the refrigerator oil composition dissolved to saturation at 100° C. under a pressure of 15 MPa, a thermal conductivity is in a range of 0.0001 to 0.01 W/m·K.

22. The method of claim 18, wherein the viscosity is in a range of 0.02 to 0.5 mPa·s.

23. The method of claim 19, wherein the dielectric constant is in a range of 1.5 to 2.2.

24. The method of claim 19, wherein the dielectric constant is in a range of 1.8 to 2.2.

* * * * *